US008228259B2

(12) United States Patent
Häger

(10) Patent No.: US 8,228,259 B2
(45) **Date of Patent: *Jul. 24, 2012**

(54) ANTENNA TOWER STRUCTURE WITH INSTALLATION SHAFT

(75) Inventor: Peter Häger, Djursholm (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 13/198,058

(22) Filed: Aug. 4, 2011

(65) Prior Publication Data

US 2011/0289866 A1 Dec. 1, 2011

Related U.S. Application Data

(63) Continuation of application No. 12/293,893, filed as application No. PCT/SE2007/050163 on Mar. 16, 2007, now Pat. No. 8,018,395.

(60) Provisional application No. 60/783,378, filed on Mar. 20, 2006.

(30) Foreign Application Priority Data

Dec. 15, 2006 (WO) ..... PCT/SE2006/050584

(51) Int. Cl.
*H01Q 1/12* (2006.01)

(52) U.S. Cl. ..... 343/890; 52/40; 52/111

(58) Field of Classification Search ..... 343/890, 343/891; 52/40, 111
See application file for complete search history.

(56) References Cited

U.S. PATENT DOCUMENTS

| | | | | |
|---|---|---|---|---|
| 857,152 | A * | 6/1907 | Brown | 248/201 |
| 1,116,111 | A * | 11/1914 | Pfund | 455/73 |
| 6,222,503 | B1 * | 4/2001 | Gietema et al. | 343/890 |
| 8,018,395 | B2 * | 9/2011 | Hager | 343/890 |
| 2009/0102743 | A1 | 4/2009 | Hager | |

FOREIGN PATENT DOCUMENTS

| | | | |
|---|---|---|---|
| EM | 1 005 102 | A1 | 5/2000 |
| JP | 2003-273616 | A | 9/2003 |

* cited by examiner

*Primary Examiner* — Tho G Phan

(57) ABSTRACT

The present invention aims to provide an antenna tower structure comprising an essentially vertical elongated tower body with an internal installation shaft provided therein. One or more radio base stations are arranged in the installation shaft in the vicinity of one or more associated antennas at the top of the tower body. The installation shaft is formed to allow personnel access to the radio base station. The tower body is comprised of a metal-reinforced concrete material, and the mass ratio between the tower body and the radio base station equipment together with the antenna arrangement exceeds 15:1. The tower body is formed so that the mass center of the tower body and radio base station equipment is lower than ½ of the tower body height.

15 Claims, 12 Drawing Sheets

ANTENNA TOWER STRUCTURE WITH INSTALLATION SHAFT

CROSS-REFERENCE TO RELATED APPLICATIONS

This application is a continuation of U.S. application Ser. No. 12/293,893, filed Sep. 22, 2008 now U.S. Pat. No. 8,018,395, now pending, which was the National Stage of International Application No. PCT/SE2007/050163, filed Mar. 16, 2007, which claims the benefit of U.S. Provisional Application No. 60/783,378, filed Mar. 20, 2006, and International Application No. PCT/SE2006/050584 filed Dec. 15, 2006, the disclosure of which is incorporated herein by reference.

TECHNICAL FIELD

The present invention generally relates to telecom towers, and in particular, to an antenna tower structure for use in a wireless communications system.

BACKGROUND

Prevailing technology for telecom towers/masts, whether self supported or guyed, are lattice steel constructions. These masts are often galvanized using hot dip galvanization, where the steel structure is coated with a layer of Zinc. Steel towers are usually manufactured for a design life between 30-50 years. Coated structures are sensible to mechanical wear, and lattice steel towers are no exception. Towers get surface damages during transportation and installation, and such damages need to be mended when the tower is installed. Since hot dip is not an option when the tower is installed, painting/spraying with cold galvanization is a method used. Damages to a protective Zink layer can not be avoided during transportation and installation and corrosion will start at damaged areas. Corrosion is what sets design life for all steel structures, and regardless of Zink cotes, certain maintenance is required to stop corrosion during a construction life time. Many new types of masts are under development. Patent documents WO02/41444 A1, US2003/0142034 A1 and U.S. Pat. No. 5,995,063 A, are some of the documents that describe a hollow/tubular antenna mast having an inside and an outside part.

Patent document, WO02/41444 A1, describes a communications mast assembly comprising a mast extending from submergible equipment housing. The housing may house air-conditioning equipment, which is located in the access room of the housing. The arrangement is being further such that the mast provides ventilation ducts in the form of inlet and outlet passages for atmospheric air circulation.

Patent document, US2003/0142034 A1, describes a telecommunications mast installation comprising a hollow mast supporting a telecommunications antenna and a foundation structure supporting the mast. According to the invention the foundation structure is in the form of an enclosed chamber situated at least partially and preferably fully, underground. The chamber defines an internal space which is accessible to personnel and which accommodates electronic equipment associated with operation of the antenna.

Patent document, U.S. Pat. No. 5,995,063 A, describes an antenna structure comprising a hollow antenna mast having an inside and an outside, a specially designed movable module disposed inside said hollow antenna mast and lifting means. The movable module has at least one antenna, at least one RF module and at least one RF transmission means connected to the at least one antenna and the at least one RF module. The lifting means permit the raising and lowering of the movable module inside the hollow antenna mast between a lower position and an upper position.

Other types of telecom towers/masts exist and are referred to as Monopoles, which basically are steel, aluminium or concrete poles on which a telecommunication system is attached on an external surface part.

Some of the problems with existing solutions and constructions are that they, in a general publics view, are perceived as an unwelcome part of a landscape view. Existing tower structures are in many cases expensive to produce, expensive and difficult to perform service on and they require separate equipment facilities such as shelters or outdoor protected equipment. In some solutions the telecom equipment is attached to the tower and is consequently exposed to weather variations.

SUMMARY

Antenna tower structures with one or more radio base stations arranged near the top in an internal installation shaft that allow personnel access to the radio base station represent a new sort of thinking. None of the mentioned prior art documents describe hollow structures were an inside of a tower is utilized as shelter, air pump, temperature equalizer, and elevator shaft for a whole antenna radio base station (RBS) all in the same construction.

An embodiment of the present invention is therefore to introduce a new antenna tower structure for use in a wireless communications network, wherein the tower is less expensive to produce and perform service on without interrupting radio transmission as long as possible.

It is an object of the present invention to introduce a new antenna tower structure having a considerably longer life cycle, better characteristics and with a more environment friendly manufacturing process.

It is another object of the present invention to introduce a new antenna tower structure where all telecom equipment is fully integrating inside an exterior surface. By such a construction geometry, and the fact that telecom equipment is totally enclosed within boundaries of construction, the radio base station site is made safer and less disturbing.

It is yet another object of the present invention to provide an antenna tower structure comprising an essentially vertical elongated tower body with an internal installation shaft provided therein. The tower further comprises one or more radio base stations are arranged in the installation shaft in the vicinity of one or more associated antennas at the top of the tower body. The installation shaft is further formed to allow personnel access to the radio base station.

It is yet another object of the present invention to provide an elevator arrangement for an antenna tower structure comprising an elevator subunit carrying at least one radio base station and associated antennas. The elevator subunit is detachable from an elevator unit at the top of the antenna tower structure by an automatic lock arrangement.

Yet another object of the present invention is to provide a wireless communications system comprising one or more antenna tower structures, wherein each structure is equipped with at least one antenna Radio Base Station serving as an access point for user equipments. The wireless communications system is characterised by the antenna tower structures being cast and divided into tubular tower sections having a hollowed cross section. The sections further comprise an arrangement for moving a whole antenna radio base station along the elongation of the antenna tower structure. The antenna radio base station is being disposed inside the tubular tower. Additionally, each antenna tower structure has at least one entrance into the antenna tower structure giving access for service of the antenna Radio Base station.

DETAILED DESCRIPTION

Figure 9:
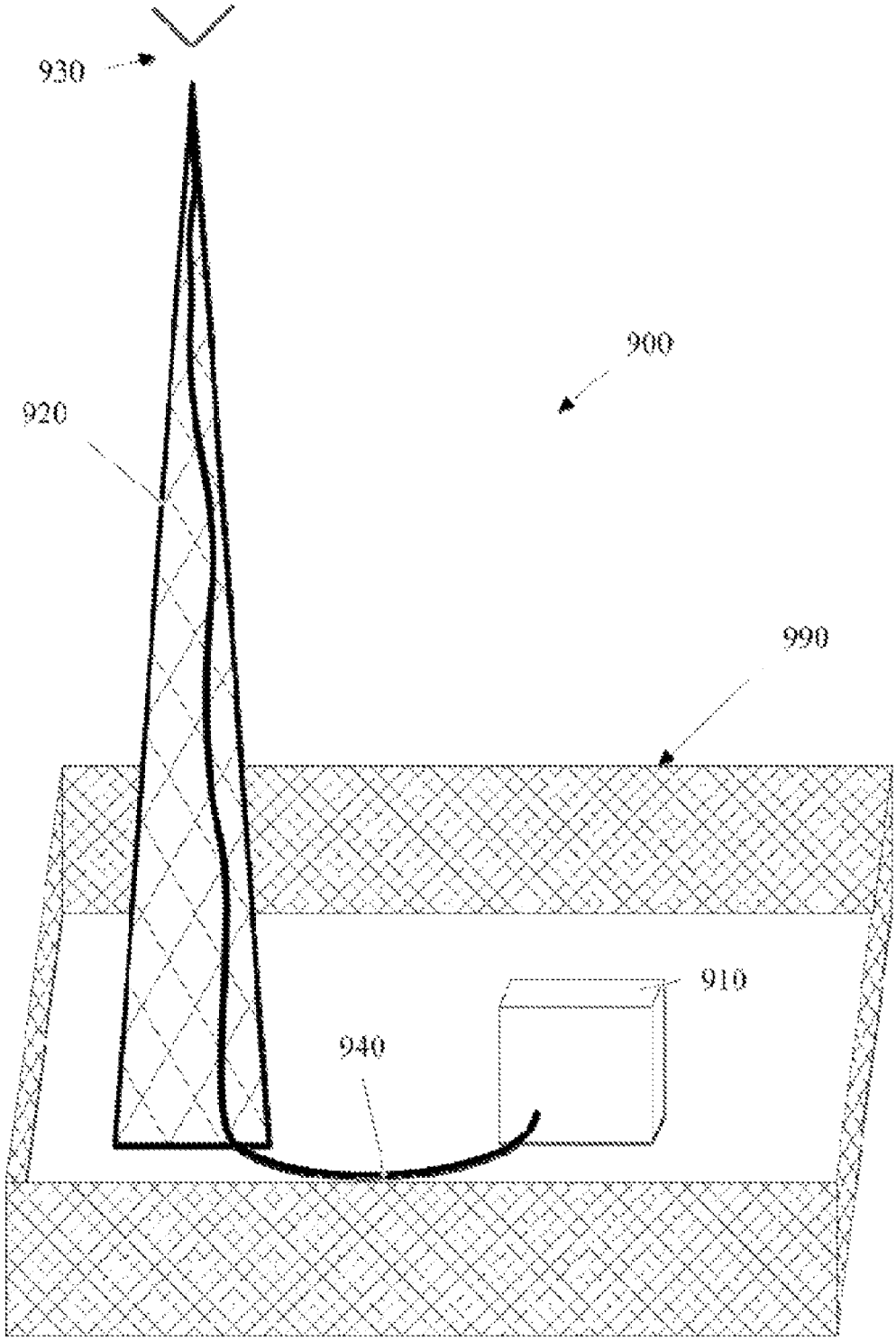
Fig. 9 (Prior Art)
FIG. 9 illustrates a prior art antenna tower having a conventional RBS facility.
Figure 10:
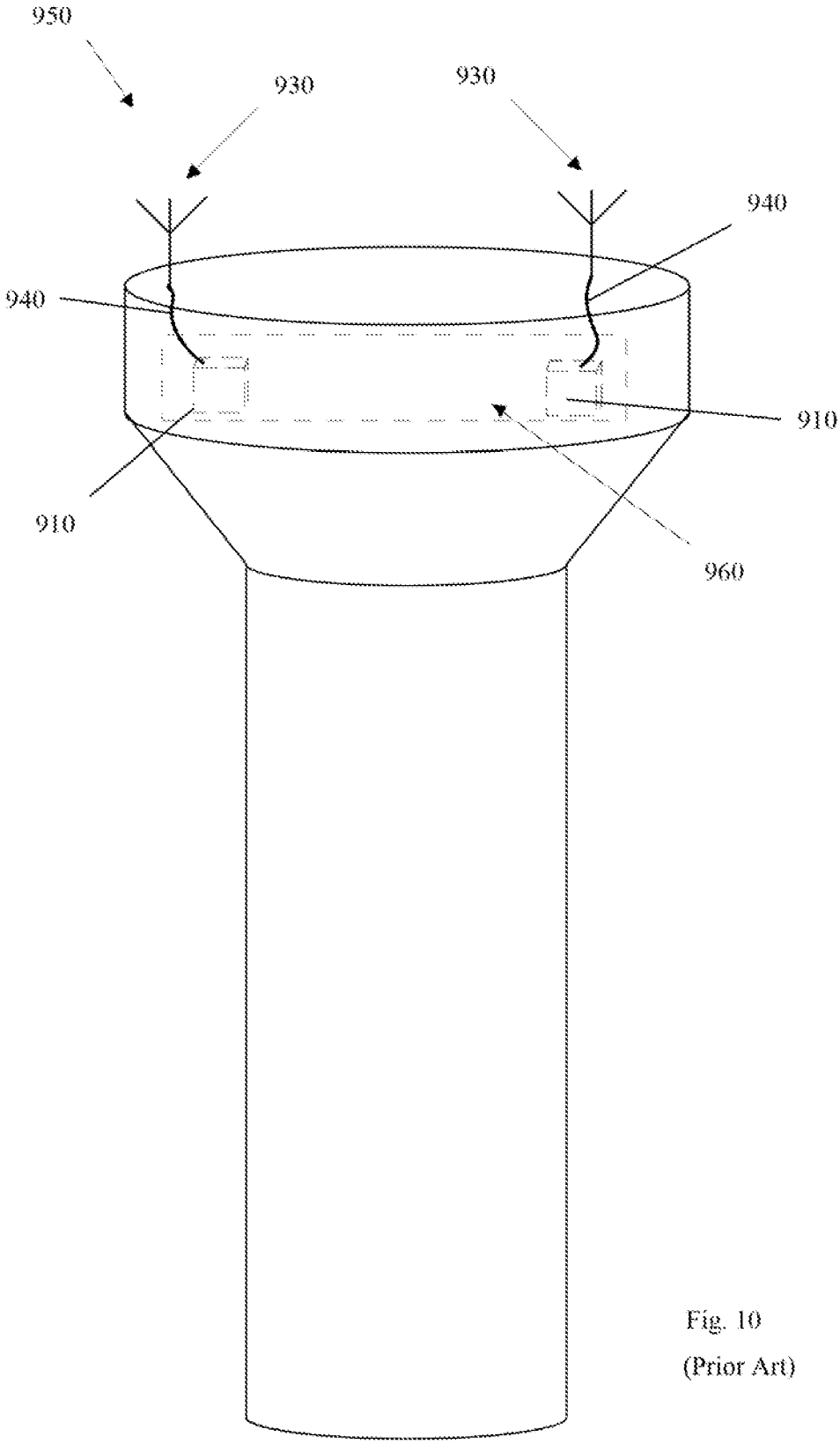
Fig. 10 (Prior Art)
FIG. 10 illustrates a prior art large facility building including a RBS installation.

Benefits of creating a tower, as defined by the independent claim are uncountable. Problems with corrosion, cables and feeders out in the Open, radio transmission interruption during service or reparation etc., are to be avoided by the present invention. Shortened feeders between the RBS and the antennas effectively reduces power losses that occur in conventional full size RBS facilities 900 (FIG. 9) with a RBS shelter 910 separate from the antenna tower 920 with antennas 930 at the top, wherein the RBS is connected to the antennas via long feeder cables 940. In U.S. patent document, U.S. Pat. No. 5,995,063 A, it is suggested that parts of RBS equipment can be placed at a top section of an antenna mast, in order not to use long feeders with substantial damping and power losses as a consequence. This technique is referred to as "main remote unit" and is used mostly for small site RBSs. The "main remote unit" concept relates to moving parts of a RBS to a location nearer the top of a tower or mast. This way some feeder loss is avoided, among other benefits. However, in order to access the RBS equipment placed at the top of the antenna, for maintenance etc, it has to be brought down to ground level, which causes radio down time. Another type of RBS installation wherein the feeder cables 940 can be kept short is large facility building like communication towers 950, as is schematically disclosed in FIG. 10. Such communication towers 950 usually have the role of main hubs in one or more radio communications network, television broadcasting systems etc., and they usually comprises installation facilities 960 near the top wherein one or more RBS 910 may be arranged with the associated antennas 930 arranged on the roof or along the sides of the communication tower. The term building like refers to the fact that such communication towers are dimensioned and designed like buildings, and often comprises stairs, a plurality of storeys, a full scale elevator system etc. As is used in this application the term antenna tower refers to a non-building like antenna carrying tower structure for individual RBS sites, even though it is not limited to house one single RBS and/or other types of wireless communication or broadcasting equipment.

Many benefits are achieved by being able to have a construction permitting placing a whole antenna Radio Base Station in top of an antenna tower structure, as in the present invention. Such benefits are for example:

- installation simplicity;
- optimal radio transmission usage. Short feeders mean that a need for tower mounted amplifiers are minimized;
- possibility to manage all possible radio standards (RBS, micro wave links, radar systems etc);
- requiring only standard radio equipment for indoor environment;
- requiring only standard antenna equipment for indoor environment;
- possibility to manage a combination of different radio standards with almost no loss at all, for example by implementing multi antenna solutions;
- possibility to manage multi antenna solutions;
- possibility for multi sector solutions.

Figure 1:
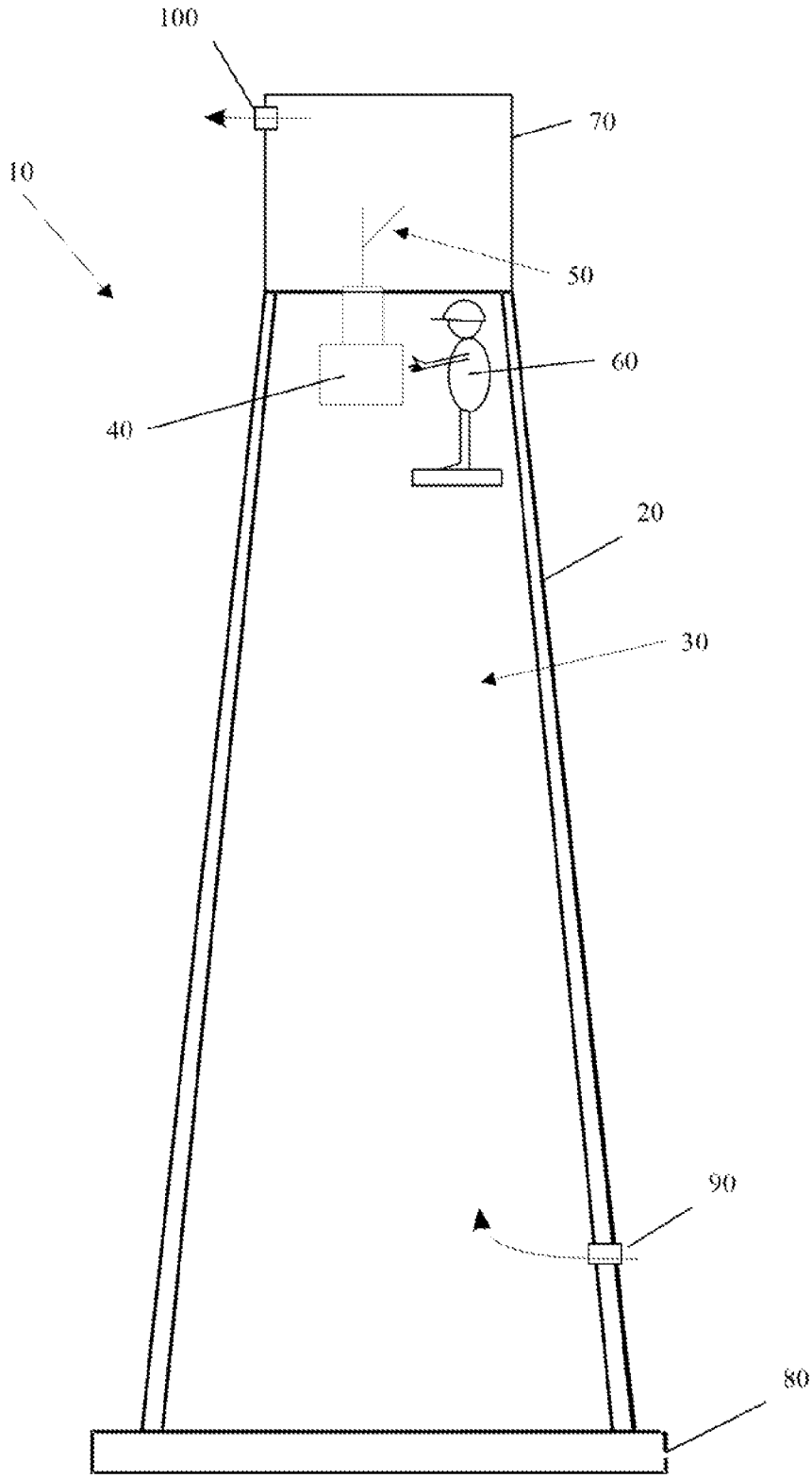
FIG. 1 illustrates an antenna tower structure according to an embodiment of the present invention.

According to one embodiment of the present invention, schematically shown in FIG. 1, there is provided an antenna tower structure 10 comprising an essentially vertical elongated tower body 20 with an internal installation shaft 30 provided therein. The installation shaft 30 is formed to house one or more radio base stations 40 in the vicinity of one or more associated antennas 50 at the top of the tower body 20. In order to minimize radio down time the installation shaft 30 is formed to allow personnel 60 access to the radio base station 40 without the need for bringing the base station down. In order for personnel to have adequate access to the RBS, the installation shaft must be large enough so that it is possible for a person occupying the space in front of the RBS to access and perform essentially all normal maintenance and service operations. The volume of the installation shaft by the RBS that is needed to allow adequate access to the RBS equipment depends on the size of the same. According to one embodiment, the RBS equipment in the antenna tower is comprised of standard rack mounted units with a standard width between 60 and 100 cm and a depth of 30 to 80 cm. According to one embodiment, the cross-sectional area of the installation shaft at the radio base station is at least, 2.0, 2.5, 3.0 $m^2$ or more. The free space in front of the RBS is at least but not limited to 1.0 to 2.0 $m^2$. According to one embodiment, the tower may be of essentially circular cross section at the radio base station height, with a radius of at least 0.7, 0.9, or 1,3 m or more.

According to one embodiment, two or more separate radio base stations are arranged in the installation shaft in the vicinity of one or more associated antennas at the top of the tower body. In order to preserve the limited space in the top section of the tower, the RBSs may be stacked one on top of the other. The RBSs maybe of the same type with respect to make and telecommunications system, but they may also belong to different operators or telecommunications systems, e.g. GSM, WCDMA, HSPA, MIMO, LTE or future type telecommunications systems. The antenna tower may also house other types radio communication equipment and associated antennas, such as wireless IP networks etc., as well as radio or television broadcasting equipment.

The installation shaft 30 may extend a limited portion of the height of the tower or all the way from the tower base to the top. In the case the installation shaft extend throughout the full height. The installation shaft may be accessed via an entrance door (not shown) or the like at the lower end thereof, and the RBS is reached by climbing or elevator means inside the shaft.

In FIG. 1 the tower body is formed as a truncated cone of essentially circular cross section. As is discussed more in detail below, the tower body may be of many different shapes. In order to protect the antennas and to establish a controlled environment inside the installation shaft, a radome, 70 is arranged extending from the elongated tower body 20 and enclosing the antennas 50. The radome 70 is designed to give required shelter for the RBS equipment 40 at the same time as it is essentially transparent to radio waves emitted from the antennas 50. According to one embodiment, the antenna tower has one or more ventilation openings 90 in the lower regions thereof, and corresponding openings in the upper region 100, above the RBS, whereby a flow of air is obtained in the installation shaft due to a stack effect. Additional mechanical cooling means, i.e. air conditioning system, may also be needed depending on the geographical location of the antenna tower and are typically placed in the base section of the antenna tower structure 10.

Figure 2:
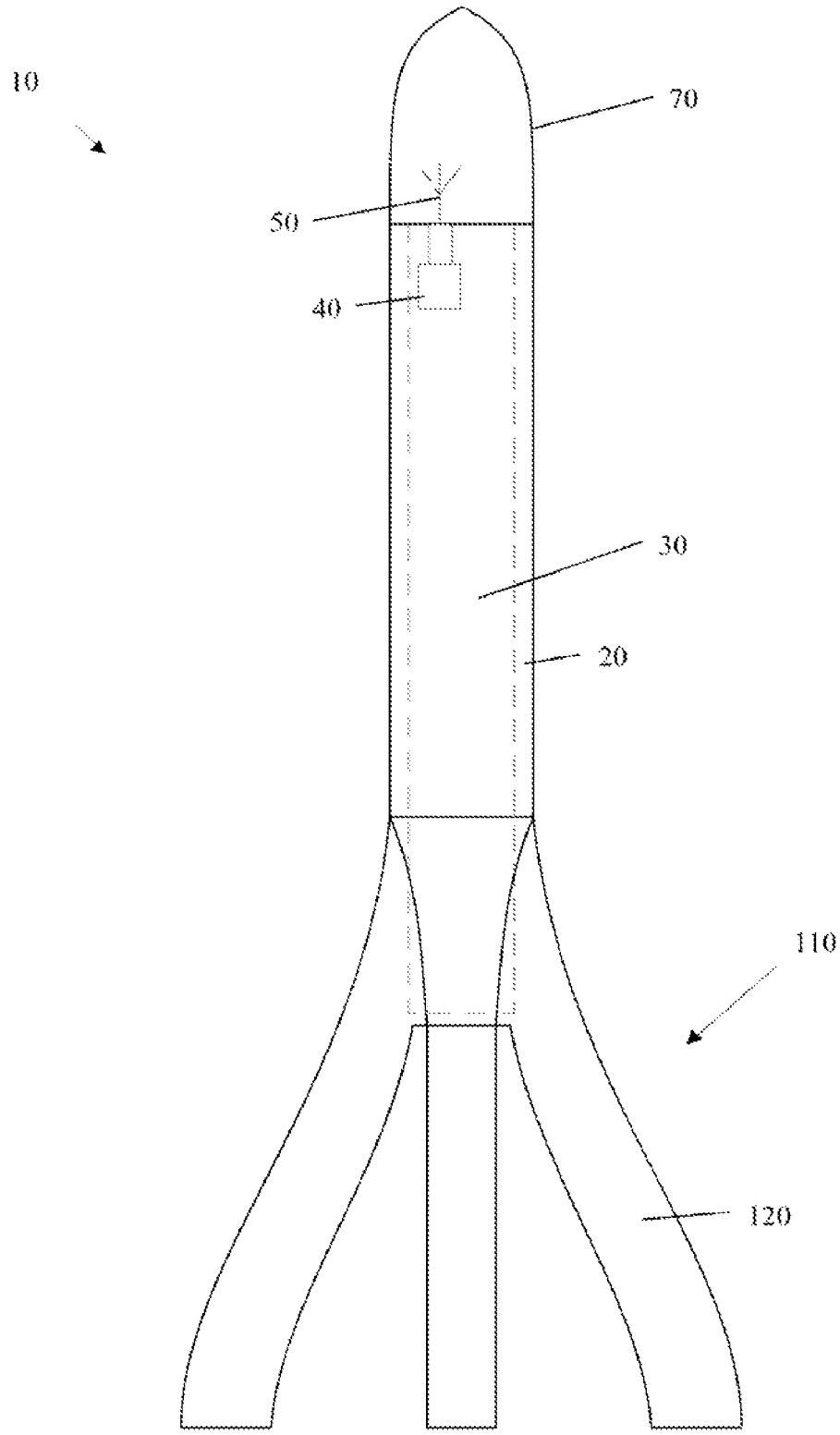
FIG. 2 illustrates an antenna tower structure according to another embodiment of the present invention.

According to one embodiment, schematically shown in FIG. 2, the elongated tower body 20 comprising the installation shaft 30 is supported a distance above ground level by a pier foundation 110 with three or more "column legs" 120. In this embodiment, the installation shaft may be accessed via a hatch (not shown) at the bottom end of the installation shaft 30. Moreover, this embodiment clearly shows the possibility to design operator specific tower structures in order to increase recognition.

The antenna tower structure according to the present invention can be taller than 15 m and for some applications as tall as 50 m, depending on the local characteristics, where it will be situated. For many environments a height of 30 to 40 m will be suitable. In order to make the tower structure more stable, the tower body may have a larger cross-sectional area at the base compared with the top. In some embodiments, also the installation shaft has a larger cross-sectional area at the base compared with the top, which results in a more spacious lower section of the installation shaft, compared with the top section housing the RBS. This lower section may be used to house bulky and heavy parts of the RBS not directly related to radio signals, such as emergency power in the form of batteries etc. The base section (bottom section), which is hollow, is large enough to fit most equipment configurations in an indoor environment. The base section is typically insulated. A benefit of having a hollow construction is avoidance of a separate shelter. Requirement for site fence is also avoided due to tower base natural scale protection and anti climbing geometry.

By designing the tower body as a self supporting structure, additional costs as well as occupied ground area related to support wires are reduced. Moreover, a self supporting structure is apt to be more visually attractive.

Figure 3:
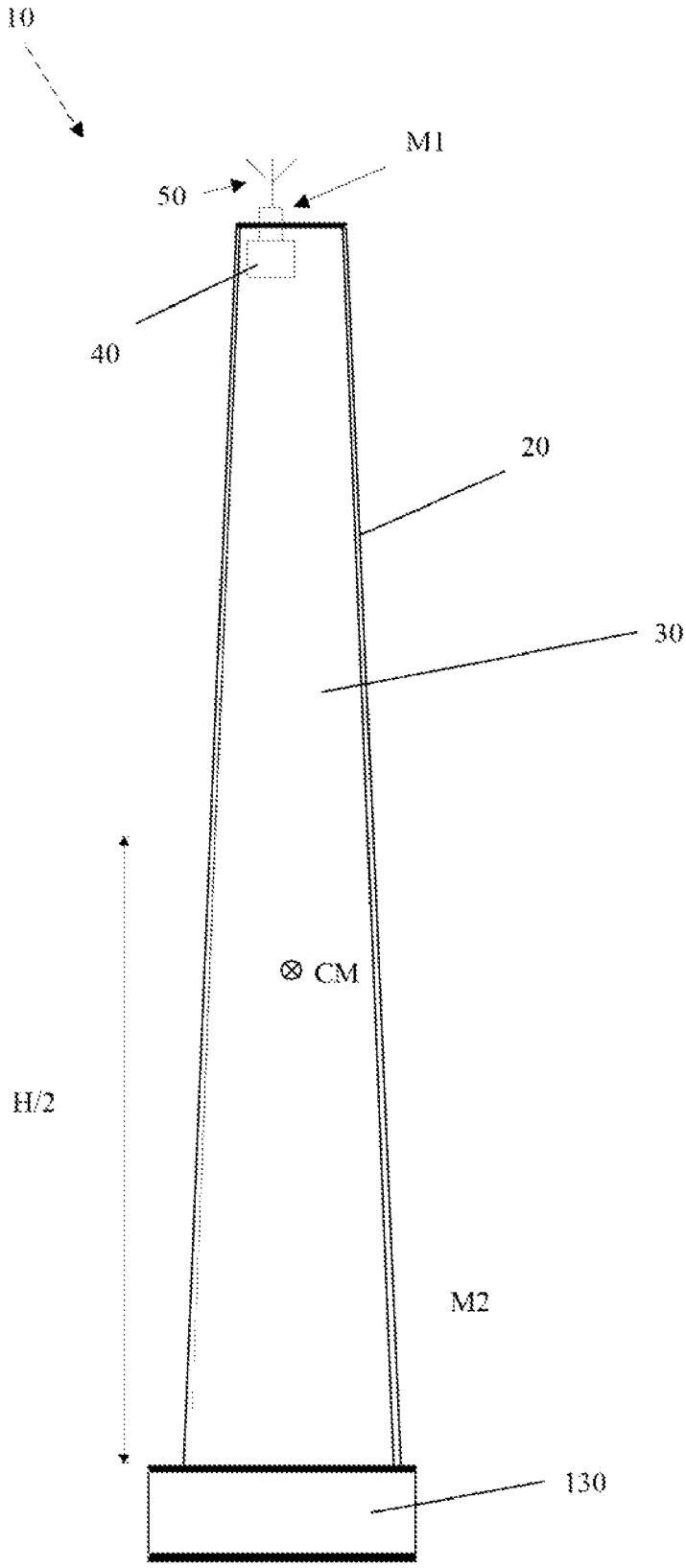
FIG. 3 illustrates an antenna tower structure according to still another embodiment of the present invention.

Even though, batteries etc. are not arranged at the top of the antenna tower structure, the accumulated weight of a RBS including associated antennas and mounting means will be in the order of 1000 kg when standard rack mounted RBS components are used. Taking into account that this mass will be arranged more than e.g. 25 m above ground or more, depending on the application, the tower body must be very rigid and strong to withstand wind loads etc, especially when the tower body is self supporting. One way to reduce the impact of the large mass of the RBS is schematically disclosed in FIG. 3, and involves designing the tower body so that the mass ratio between the tower body 20 M2 (excluding the fundament 120 and the radio base station equipment 40 together with the antenna arrangement 50 M1 exceeds 20:1 or 15:1. Moreover, the tower body 20 should be formed so that the mass centre CM of the tower body and radio base station equipment is lower than about ½ of the tower body height, without reducing the stiffness at the top end too much. According to one embodiment, as will be discussed in greater detail below, the tower body 20 is essentially comprised of a metal reinforced concrete material. By designing the tower body of metal reinforced concrete, the above stiffness and mass aspects are possible to accomplish. Moreover, a thin walled concrete design will result in an extremely cost effective yet durable design.

Figure 4:
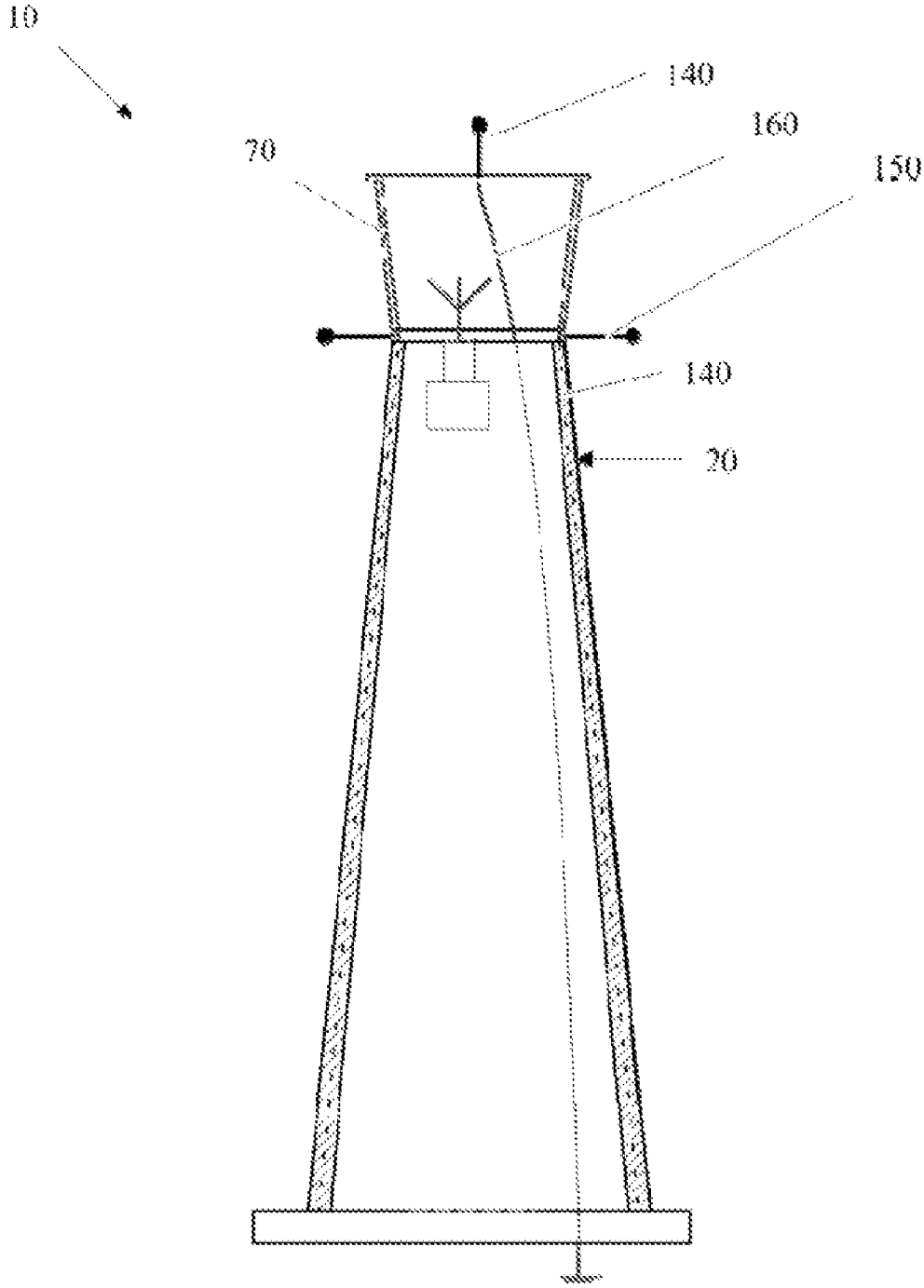
FIG. 4 illustrates an antenna tower structure according to yet another embodiment of the present invention.

In order to prevent the antennas and RBS from devastating lightning strikes, the antenna tower structure may be provided with lightning protection means in the form of one or more air terminators 140, 150, as is schematically shown in FIG. 4, connected to earth via down conductors 160. In FIG. 4 one air terminator 140 in the form of a vertical rod, extends from the top surface of the radome 70, and thus provides a low electrical potential at the highest point of the antenna tower 10, thus attracting lightning strikes. In combination with or instead of the vertical rod 140 there are provided two or more air terminators in the form of the essentially horizontally extending rods 150 are arranged at the top of the tower body 20. The horizontal rods 150 are formed to provide a "protection ring" of low potential surrounding the top section of the tower body, deflecting and attracting lightning strikes. When the tower body 20 is comprised of a metal reinforced 140 concrete material, at least a portion of the metal reinforcement 140 may be connected as down conductor from the lightning protection means 140,150.

Figure 5A:
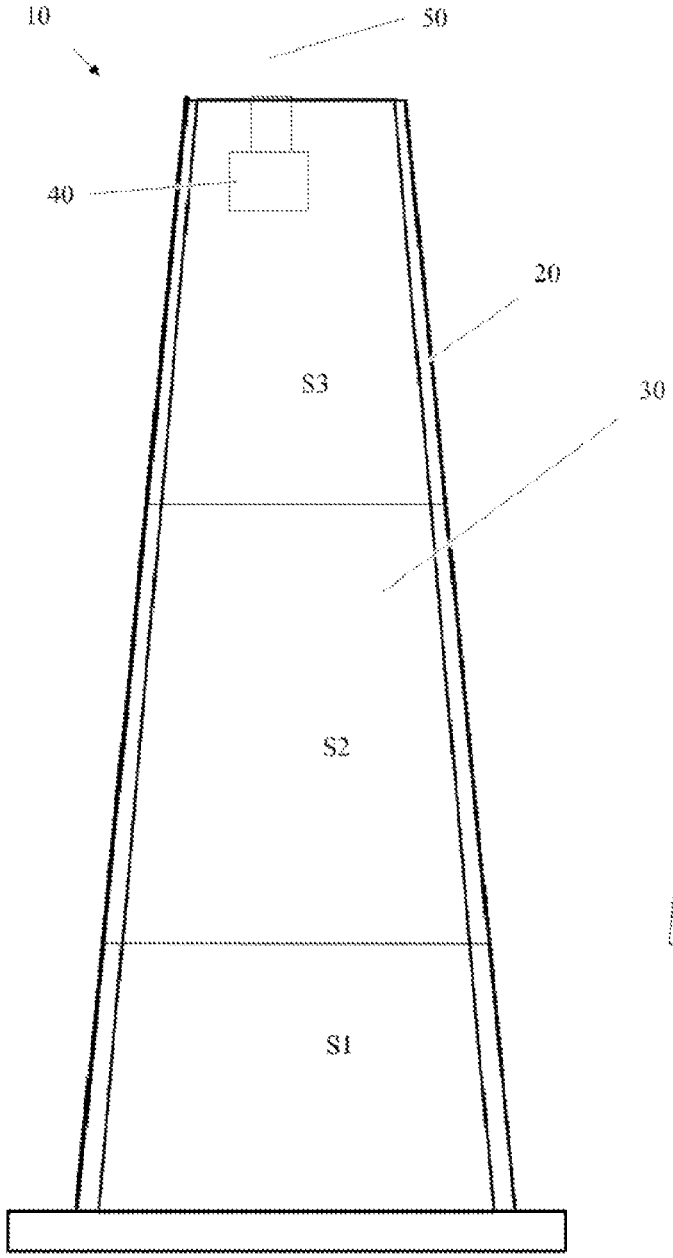
FIGS. 5*a* and 5*b* illustrate an antenna tower structure according to an embodiment of the present invention.
Figure 5B:
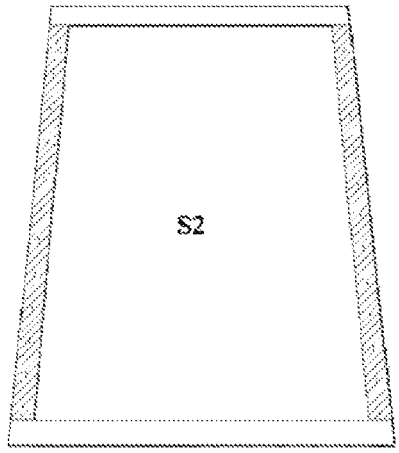

According to one embodiment as is shown in FIGS. 5*a* and 5*b* the elongated tower body 20 is comprised of two or more modular segments S1, S2 and S3 that are interconnected to form the antenna tower 10. By making the elements in sections S1,S2,S3 . . . , the tower body 20 with the installation shaft 30 can be prefabricated and thereafter assembled on site. This modular approach is very suitable for production of tower bodies of reinforced concrete, as will be discussed in greater detail below. Moulding the antenna tower in concrete makes it possible to attach insulation in mould and fitted while the sections are being cast. Electrical conduits may also be placed in the mould as well as other details. However, the antenna tower may advantageously also be made of other materials such as, but not limited to, metal, plastics, cement based materials, wood, glass, carbon fibre and composites of the same. According to one embodiment, at least a section of the antenna tower is comprised of a fibre reinforced plastics sandwich material. Moreover, individual segments in a modular antenna tower may be comprised of two or more materials or a combination of such materials, and different segments in a modular antenna tower may be comprised of different materials. According to one embodiment, one or more segments at the top of the antenna tower are comprised of a light weight material in order to lower the centre of mass of the antenna tower.

Figure 6:
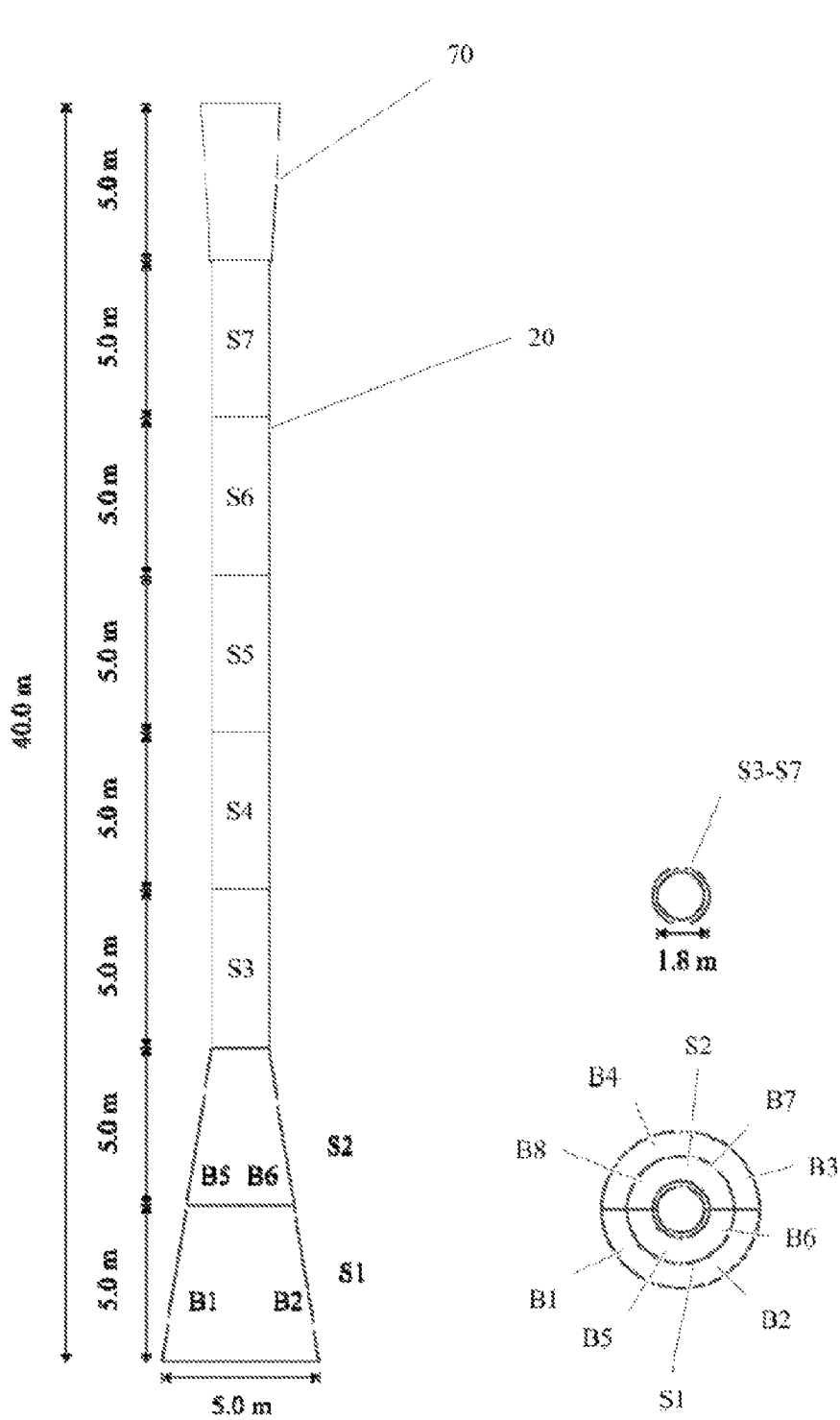
FIG. 6 illustrates an antenna tower structure according to yet another embodiment of the present invention.

FIG. 6 shows one embodiment of a tower body that is comprised by two base sections S1 and S2 comprised of eight sections B1-B8, and a plurality of modular tower segments S3-S7. By forming the base segment of radial sections B1-B8 production and transport of the base section is facilitated. The disclosed embodiment has a circular cross-section, and the base diameter is 5.0 m, whereas the diameter of the modular tower segments is 1.8 m. The antenna tower is provided with a radome 70 and the total height including the radome 70 is 40 m. Moreover, at least two of the modular tower segments S1-S5 are essentially identical, whereby they can be subsequently moulded in the same mould. By omitting or adding one or more such "identical" segments S1-S5 towers of different heights can be provided without altering the mould design.

Adjacent modular segments are interconnected in any suitable way, such as by bolts, rivets, adhesives, welding or the like. In order to facilitate interconnection, the adjacent modular segments may be provided with mating interconnection means. The mating interconnection means may comprise mating guide structures to ensure precise angular and lateral alignment during assembly. According to one embodiment wherein the modular segments are comprised of metal reinforced concrete, the interconnection means comprises a metal member that is firmly attached to the metal reinforcement structure, e.g. by welding or bolt and nuts prior to moulding of the segment. In an embodiment comprised of metal reinforced concrete wherein at least a portion of the metal reinforcement is connected as down conductor from a lightning protection means, at least a part of the metal reinforcement structures in two adjacent modular segments are electrically connected, e.g. in that two mating interconnection means provides electric contact between at least a portion of the metal reinforcement members in the two segments.

According to one embodiment, there is provided a modular antenna tower segment comprising an elongated segment body with an internal installation shaft provided therein, and interconnection means at one or both longitudinal ends for interconnection of two or more tower segments to form an antenna tower body. As discussed above the segment body may essentially be comprised of metal reinforced concrete. The modular concept of the antenna tower according to the present invention, involving prefabrication of modular antenna tower segments greatly reduces the on site assembly time required to build an antenna tower. One way to further reduce the on site assembly time is to pre-install as much as possible of the equipment in the installation shaft, such as climbing means, elevator guides, power cables, etc. According to one embodiment the radio base station with associated antennas is pre-installed in the installation shaft of one modular antenna tower segment, and is thus arranged in place in the installation shaft at the same time as the modular segment is lifted in place. In order to reduce the risk of damaging the RBS and/or the antennas, the RBS is suitably pre-installed in the top segment, which is liften in place as the last segment. In this way, the modular segment containing the RBS equipment will have the function of transport protection.

There is also provided a method for assembly of a modular antenna tower comprising the step: interconnecting two or more prefabricated elongated modular antenna tower segments with an internal installation shaft provided therein in essentially vertical position to form an antenna tower body. According to one embodiment, the method further comprises the step: securing a radio base station with associated antennas in the installation shaft of one of the prefabricated elongated antenna tower segments before said segment is interconnected.

Figure 11:
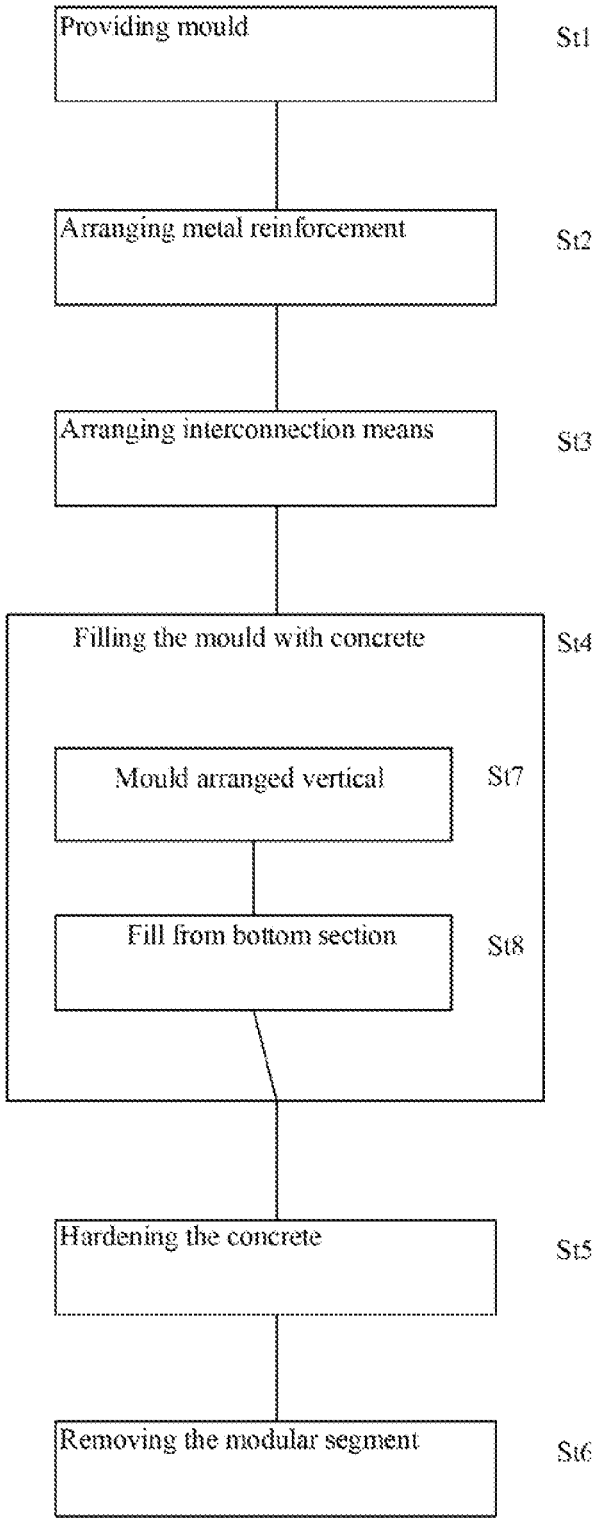
FIG. 11 is a flow chart illustrating a method according to an embodiment of the present invention.

Further, there is provided a method of producing a segment of a modular antenna tower, as is shown in FIG. 11, comprising the steps:

St1: providing a mould defining an elongated tower body with an internal installation shaft provided therein St2: arranging metal reinforcement members at predetermined positions in the mould St3: arranging interconnection means at one or both of the longitudinal ends of the mould, St4: filling the mould with concrete St5: hardening the concrete, and St6: removing the modular segment from the mould.

According to one embodiment, the step

St7: of filling the mould is performed with the longitudinally axis of the mould arranged essentially vertical, and St8: by selecting a suitable concrete composition, the mould may be filled from the bottom section thereof.

Other examples of cross-section shapes are oval, square, rotating, triangular, rectangular, hexagonal, octagonal etc. The antenna tower embodiments disclosed herein are all of conical shape in that the base has a larger cross sectional area than the top section of the tower, but other shapes are also under consideration. Sections are formed upon request and can be made to represent a signature as of an operator or to better fit into a landscape view. From a business perspective an important aspect of the present invention is to introduce a costumer specific antenna tower shape(s), working as a signature for an operator. As an alternative aspect, the antenna tower structure may form part of a support for an advertising board.

Figure 7A:
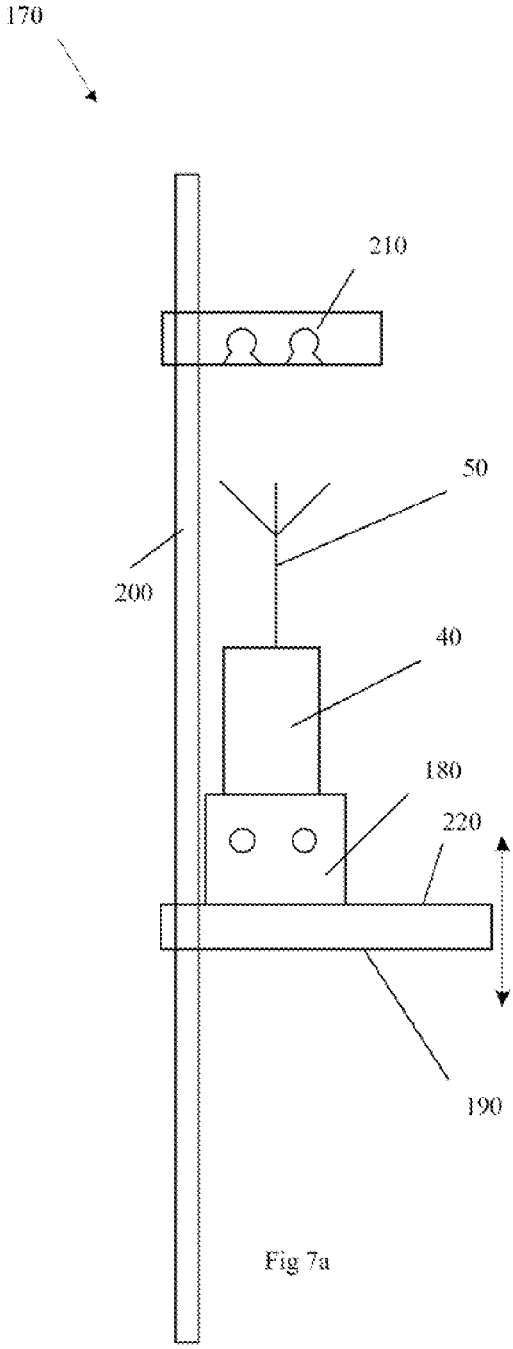
FIG. 7*a* and 7*b* illustrate an elevator arrangement according to an embodiment of the present invention.
Figure 7B:
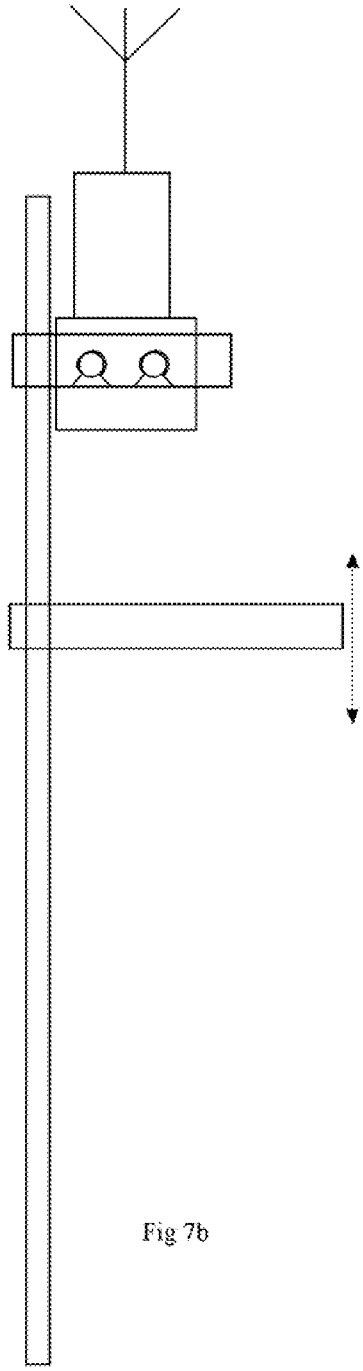

In addition to the possibility to access the RBS at the top of the tower body, it may some times be necessary to accept radio down time e.g. in order to perform extensive maintenance or to substitute major components. In order to facilitate such large scale operations, the radio base station(s) and associated antennas are arranged on an elevator unit that can be raised and lowered in the installation shaft by an elevator arrangement. FIGS. 7*a* and 7*b* show one embodiment of an elevator arrangement 170 comprising an elevator sub unit 180 carrying the radio base station(s) 40 and associated antennas 50 arranged to travel with an elevator unit 190 along elevator guides 200. The elevator arrangement 170 further comprises a drive arrangement (not shown). The sub unit 180 is arranged so that it can be detached from the elevator unit 190 and be retained at the top of the antenna tower structure by a mechanical lock arrangement 210. Moreover, the elevator unit 190 may comprise a transport platform 220 for transporting equipment to and from the radio base station(s), and to be used as working platform for maintenance of the radio base station equipment.

According to one embodiment the mechanical stop arrangement 210 is automatically locked when the elevator sub unit 180 during upwards motion reaches a predetermined locking position in the installation shaft. In order to lower the sub unit 180, the mechanical stop arrangement 210 is automatically unlocked when the elevator sub unit 180 is lifted a predetermined distance from the locking position, whereby the elevator sub unit 180 is free to follow the elevator unit 190 downwards in the installation shaft past the locking position.

Figure 8A:
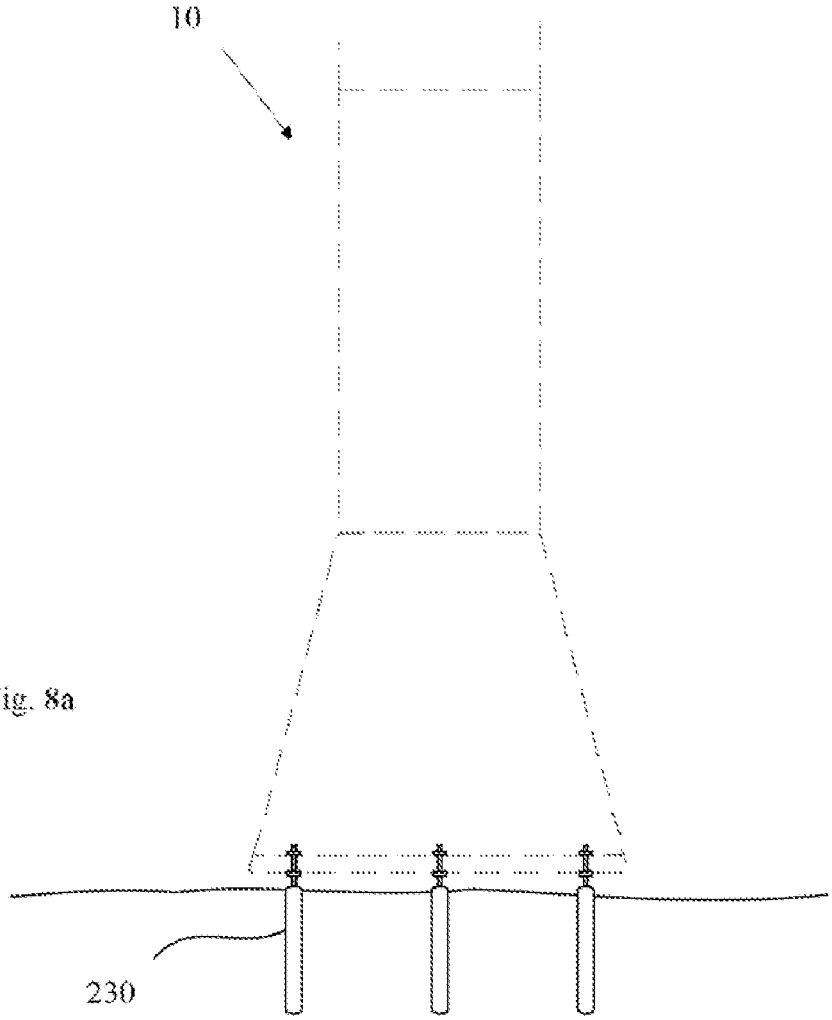
FIGS. 8*a* and 8*b* illustrate a foundation for antenna tower structure according to an embodiment of the present invention.
Figure 8B:
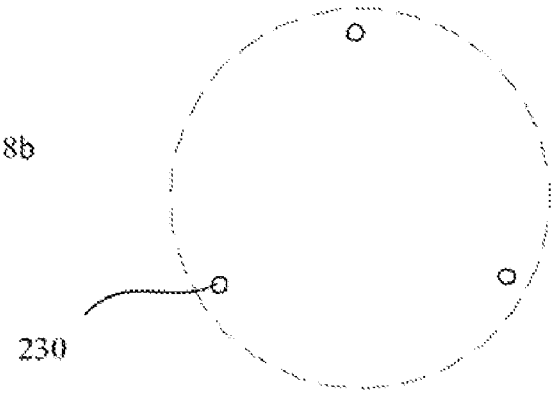

FIGS. 8*a* and 8*b* show one example of a foundation using expandable steel piles 230 that may be used to support the antenna tower 10 according to the present invention. In the disclosed embodiment, the number of steel piles 230 is reduced to 3, whereas the number of piles 230 obviously has to be adapted to the specific tower design. The use of steel piles 230 reduces the amount of ground preparations before the tower 10 can be erected, as they can be adjustably connected to the base of the tower, thy are thus apt to accommodate for non flat or inclined ground surfaces etc. According to one embodiment, one or more steel pile 230 is substituted by a concrete plinth or the like depending on ground characteristics. According to still another embodiment, the foundation is a traditional concrete raft and chimney foundation.

As mentioned above, several of the antenna tower embodiments disclosed herein are advantageously made of metal reinforced concrete. Specifically, the f concrete/mix may be selected in such a way that it is possible to guarantee a design life of >100 years without maintenance. The concrete antenna tower structure is not sensible to scratches and surface damages in a same way as coated steel structure. Preferably, the tower will not be painted, colors come from pigmented concrete.

These are some benefits discovered when manufacturing and developing antenna tower structures made of concrete:

1. Thermally Slow

An RBS has requirements for surrounding temperature usually within approximately +5 degrees to +45 degrees Celsius. This will cause a problem in hotter climates with very high temperatures daytime. However, temperatures nighttime, even in hotter climates, goes down many degrees. A conventional, thermally fast, construction such as telecom shelters is using active cooling such as air conditioners to cool equipment. Active cooling consumes a lot of power and is therefore the no. 1 operational expenditure (OPEX), the ongoing costs for running a product, for an operator of a network. Concrete is a thermally slow material. The antenna tower structure intends to utilize this in leveraging of temperature during 24 h in hot climates. At night time the antenna tower structure will cool down as a consequence of lower outdoor temperature. Lower outdoor temperature, "Stack effect", will not alone be able to cool the antenna tower structure and mechanical forced/controlled ventilation maybe required. Daytime when temperature again raises the mass in a cooled antenna tower structure will manage to cut a peak temperature and is therefore capable of maintaining a cooler indoor climate.

2. Local Production

Steel lattice towers and other kinds of towers require factory manufacturing. Precise cutting of steel, welding environment and hot dip galvanization all require factory indoor facilities. Steel lattice towers are often manufactured remotely from a site establishment and are often exported between countries and continents.

According to an embodiment of the present invention the antenna tower structure is cast in concrete. Concrete is a mix of cement, aggregates and water. As long as ingredients are available it can be mixed any where. The antenna tower structure will be made of sections and every section will require a mould. The mould is made of steel and sets the exact measurements for the cast elements. The moulds can be reused thousands of times. Since the manufacturing process is quite simple, providing the mould is adequately made, the antenna tower structure can be produced in temporary established field factories. Thereby cutting a major part of the costs and adding considerably simplicity to the manufacturing process, as well as being more environment friendly at the same time.

3. Cost Reduction

Cost criteria are already discussed above. The antenna tower structure will be considerably heavier than a steel lattice tower but the cost per ton will be considerably lower and in total material cost for the antenna tower structure will be approximately half of an equivalent lattice tower. With regards to production, casting of elements is a quite simple process and production costs for casting of elements are lower than for production of steel lattice towers.

4. Rigidity/Stiffness

From a construction point of view, concrete offers benefits compared with steel structures like for example sway damping and wear out.

5. Weight/Foundation

Forces that act on a tower are related to wind. Design parameters are wind area, wind speed, surface factors, return period, terrain category etc. In order not to turn over when exposed to wind, towers use a foundation. A prevailing foundation technique for steel lattice towers is a raft and chimney construction made of on site cast concrete. Example concrete raft volume is approximately 35 cubic meters (m3), of course dependent on height of tower and load cases etc, but as a rule of thumb. Translated into weight it is equivalent to approximately 85 tons. One embodiment of a antenna tower structure has a typical calculated weight of approximately 30 tons (13 cubic meters concrete). The antenna tower structure has a majority of its weight close to ground, which makes it a very stable construction with regards to overturning. Total weight above ground of the antenna tower structure means that the need for a foundation decreases, or is made differently. The foundation for the antenna tower structure will be made by expandable steel piles sometimes in combination with soil anchors. This is a quick and less costly method than on site cast foundation.

6. Free Shaping

Concrete can be shaped into any form and/or color. Exact replicas can be made in thousands from the same mould. This is an intention with the antenna tower structure, to create different and unique shapes. Lattice steel does not have this freedom.

7. Environment

Production of steel is energy consuming. According to statistics of Embodied Energy Coefficients developed at Victoria University, Wellington NZ, galvanized virgin steel has a coefficient of 34.8 MJ/Kg. Pre-cast concrete typically require 2.0 MJ/Kg. The antenna tower structure body consists of reinforced pre-cast concrete. According to index steel rebar has a coefficient of 8.9 MJ/Kg which is one component in the tower tube. Calculated for a preferred tower tube is ~200 kg reinforcement per cubic meter of concrete. This implies 1780 MJ for the rebar in every cubic meter of concrete. Example tower tube consumes approximately 13 cubic meters concrete. Concrete has a specific weight of approximately 2500 kilo gram/cubic meter. This implies 2×2500 MJ per cubic meter of concrete. In total a preferred example of a tower will have a coefficient of 13×(1780+5000) MJ=88,140 MJ. A steel lattice tower (40 meters) has an approximate weight of 9.000 kg. 9000×34.8 MJ=313,200 MJ.

Thus, the antenna tower structure of the example consumes about 25% of the energy required to produce an equivalent lattice tower.

Summing up, the antenna tower structure of the present invention is considered to have many benefits compared to prior art towers/masts created from other materials than concrete.

Example materials in the tower is for the purpose of this invention, steel fibrous cement based composites i.e. concrete blended metal mesh and/or rebar. Other materials are also to be considered able, are such as, but not limited to, metal, plastics, cement based materials, wood, glass, carbon fibre and composites of the same.

Figure 12:
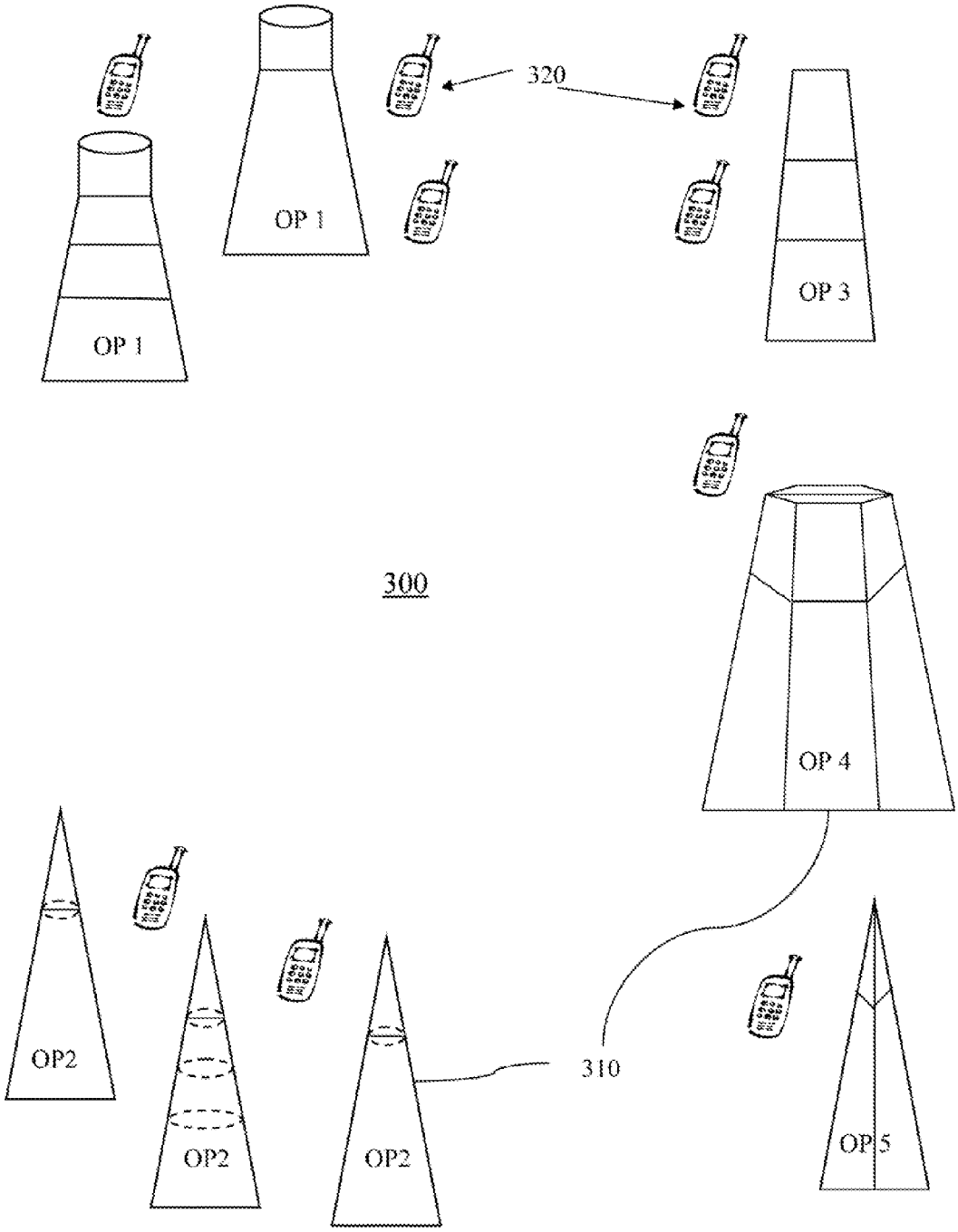
FIG. 12 is a block diagram illustrating a system according to an embodiment of the present invention.

FIG. 12 is a block diagram illustrating a system for wireless communication in accordance to an embodiment of the present invention. The wireless communications system 300 comprises one or more antenna tower structures 310 each equipped with at least one antenna Radio Base Station serving as an access point for user equipments 320. The antenna tower structures of the system are being cast and divided into tubular tower sections having a hollowed cross section. The sections are equipped with an arrangement for moving a whole antenna radio base station along the elongation of the antenna tower structure, wherein the antenna radio base station is being disposed inside the tubular tower. Each antenna tower structure have at least one entrance into the antenna tower structure giving access for service of the antenna Radio Base station. The system 30, permits operator specific antenna tower structure designs (OP1, OP2, OP3, OP4, OP5 etc).

In a further embodiment, operator specific designs makes it more simple for service personnel to identify a specific antenna tower structure among other towers, wherein equipment in the tower is to be served, updated or reconfigured.

While the invention has been described with reference to specific exemplary embodiments, the description is in general only intended to illustrate the inventive concept and should not be taken as limiting the scope of the invention.

It will be understood by those skilled in the art that various modifications and changes may be made to the present invention without departure from the scope thereof, which is defined by the appended claims.

The invention claimed is:

1. An antenna tower structure comprising:

an essentially vertical elongated tower body with an internal installation shaft provided therein;

one or more radio base stations that are arranged in the installation shaft in vicinity of one or more associated antennas at the top of the tower body;

wherein the installation shaft is formed to allow personnel access to the radio base stations;

wherein the tower body essentially is comprised of a metal reinforced concrete material;

wherein the mass ratio between the tower body and the radio base station equipment together with the antenna arrangement exceeds 15:1; and wherein the tower body is formed so that the mass center of the tower body and radio base station equipment is lower than ½ of the tower body height.

2. The antenna tower structure according to claim 1, wherein the installation shaft extends from the tower base to the top.

3. The antenna tower structure according to claim 1, wherein the cross-sectional area of the installation shaft at the radio base station is at least 1.0 $m^2$.

4. The antenna tower structure according to claim 1, wherein the tower at the radio base station is of essentially circular cross section, with a radius of at least 0.7 m.

5. The antenna tower structure according to claim 1, wherein the tower body and the installation shaft have a larger cross-sectional area at the base compared with the top.

6. The antenna tower structure according to claim 1, wherein the installation shaft is internally climbable.

7. The antenna tower structure according to claim 1, wherein the elongated tower body is comprised of two or more modular segments.

8. The antenna tower structure according to claim 7, wherein at least two of the modular segments are of the same dimensions.

9. The antenna tower structure according to claim 7, comprising a base segment with a lower end of larger cross-sectional area compared to the cross-sectional area of the modular segments arranged thereon.

10. The antenna tower structure according to claim 9, wherein the base segment is comprised of two or more interconnected sections.

11. The antenna tower structure according to claim 1, wherein the tower is a self30 supporting structure.

12. The antenna tower structure according to claim 1, comprising lightning protection means in the form of one or more air terminators connected to earth via down conductors.

13. The antenna tower structure according to claim 12, wherein the tower body essentially is comprised of a metal reinforced concrete material; and wherein at least a portion of the metal reinforcement is connected as down conductor from a lightning protection means.

14. The antenna tower structure according to claim 1, comprising a radome extending from the elongated tower body and enclosing the antennas.

15. The antenna tower structure according to claim 1, wherein the radio base station(s) and associated antennas are arranged on an elevator unit that can be raised and lowered in the installation shaft by an elevator arrangement.

* * * * *